United States Patent [19]

Blanchard

[11] 4,422,476

[45] Dec. 27, 1983

[54] FLUIDIC CONTROL DEVICES

[75] Inventor: Alan Blanchard, Preston, England

[73] Assignee: United Kingdom Atomic Energy Authority, London, England

[21] Appl. No.: 474,147

[22] Filed: Mar. 10, 1983

[30] Foreign Application Priority Data

Mar. 16, 1982 [GB] United Kingdom ..... 8207670

[51] Int. Cl.[3] ..... F15C 1/16

[52] U.S. Cl. ..... 137/810; 137/813; 137/833

[58] Field of Search ..... 137/810, 812, 813, 833

[56] References Cited

U.S. PATENT DOCUMENTS

| | | | |
|---|---|---|---|
| 3,219,048 | 11/1965 | Palmisono | 137/813 |
| 3,336,931 | 8/1967 | Fox et al. | 137/813 |
| 3,444,878 | 5/1969 | Mayer | 137/813 |
| 3,511,257 | 5/1970 | Chow | 137/813 |
| 3,519,008 | 7/1970 | Fish | 137/813 |
| 3,722,522 | 3/1973 | Randall | 137/812 |
| 4,112,977 | 9/1978 | Syred et al. | 137/812 |

*Primary Examiner*—A. Michael Chambers
*Attorney, Agent, or Firm*—King and Liles

[57] ABSTRACT

A fluidic control device, in particular a vortex amplifier, comprises a casing having fluid inlet, outlet and control ports. A vortex chamber is formed within the casing by a plate which is spaced from a wall of the casing by members which each define a part of the periphery of the vortex chamber. Each member has a channel in communication with a respective control port for introducing control fluid flow into the vortex chamber. An aperture is formed in the plate adjacent each channel to divert a portion of the control flow to the opposite side of the plate and facing the inlet port whereby to reduce instability over the operating range of the amplifier.

5 Claims, 4 Drawing Figures

FLUIDIC CONTROL DEVICES

BACKGROUND OF THE INVENTION

The present invention concerns fluidic control devices, in particular vortex amplifiers, in which a supply fluid flow is controlled by forming in the fluid a vortex which operates to control the supply fluid flow, the vortex being formed by the injection of a control fluid flow into the supply flow. Such a device requires a chamber in which the vortex can be formed, a supply fluid inlet and outlet to and from the chamber and at least one further inlet to the chamber arranged to direct a control fluid flow to interact with and throttle the supply fluid flow.

Vortex amplifiers can be used to control depression in radioactive containments, the amplifiers being particularly attractive to the nuclear industry as they do not comprise any moveable component parts which could require repair and maintenance. However, vortex amplifiers suffer the disadvantage that their characteristics can exhibit multivalued regions within normal flow range and this can result in instability.

The present invention seeks to provide vortex amplifiers which do not have characteristics exhibiting multivalued regions.

FEATURES AND ASPECTS OF THE INVENTION

According to the present invention a fluidic control device, in particular a vortex amplifier, comprises a casing, a supply fluid inlet communicating with the interior of the casing through a central opening in one end wall of the casing, a fluid outlet shaped as a diffuser communicating with the interior of the casing through a central opening in the opposite end wall of the casing, a plate within the casing and cooperating with the opposite end wall to form a vortex chamber, at least one further inlet for a control fluid in a wall of the casing, a spacer member defining a part of the periphery of the vortex chamber and disposed between the plate and the opposite end wall of the casing, a channel in the member communicating with the further inlet for directing the control fluid into the vortex chamber, and in which an aperture is formed in the plate adjacent the channel in the member whereby to divert a portion of the control fluid to the side of the plate facing the supply fluid inlet.

It has been found that diverting a part of the control fluid flow to the inlet side of the plate to mix with the incoming supply fluid flow eliminates or decreases the multivalued regions hitherto obtained in the characteristics of the amplifier without substantial deterioration in the performance of the vortex amplifier.

DESCRIPTION OF THE DRAWINGS

A constructional embodiment of a vortex amplifier according to the invention will be described, by way of example, with reference to the accompanying drawings; in which.

DESCRIPTION OF THE PREFERRED EMBODIMENT

Figure 1:
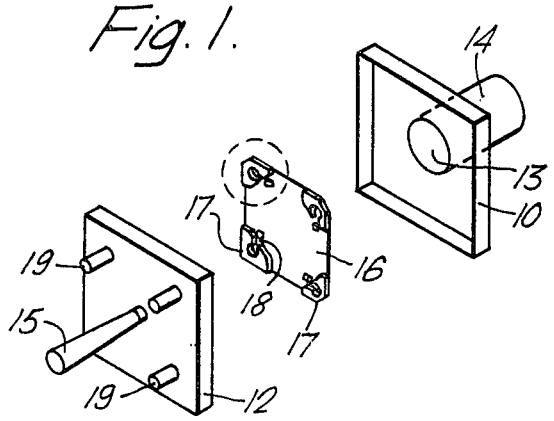
FIG. 1 is an exploded view of a vortex amplifier.

A vortex amplifier comprises a casing formed from two abutting body portions 10 and 12 which can be releasably secured together by any convenient means, for example, by nut and bolt assemblies engaging peripheral flanges on the two body portions. A central opening 13 in the end wall of body portion 10 communicates with an inlet 14 which conveniently can be butt welded to the body portion. Likewise an outlet 15 in the form of a diffuser communicates with the interior of the casing through a central opening in the end wall of the body portion 12.

Figure 2:
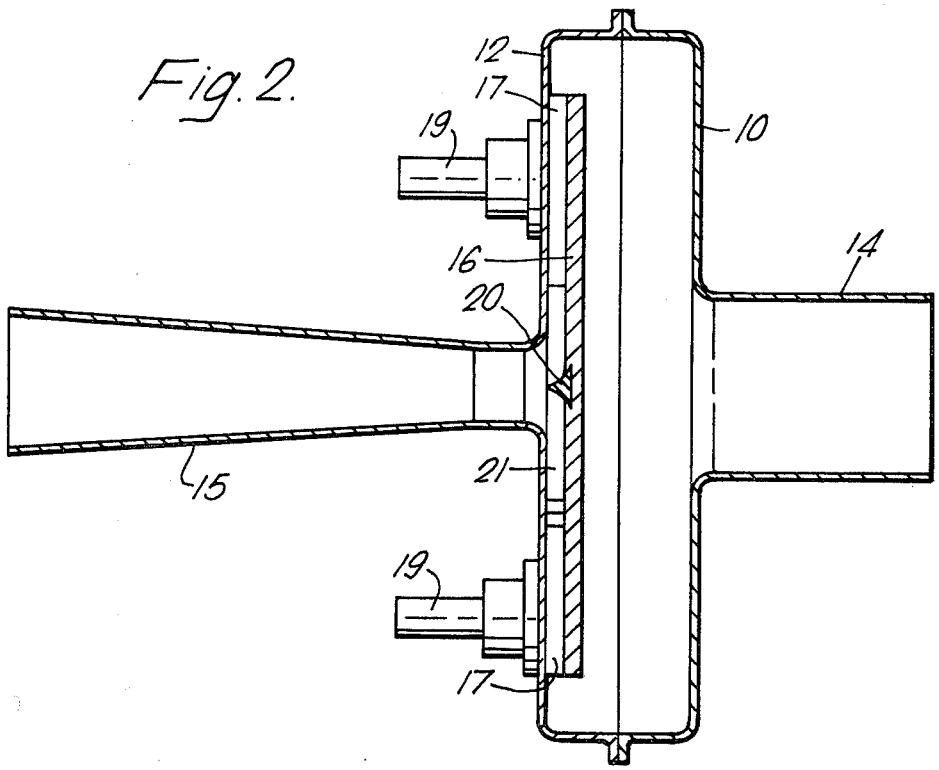
FIG. 2 is a section through the amplifier when assembled.

A retangular partition plate 16 is positioned within the casing at a fixed, predetermined distance from the end wall of the body portion 12 by means of four spacer plates 17 disposed one at each corner of the partition plate 16. Each spacer plate 17 is formed with a channel or slot which terminates in a nozzle 18. Each spacer plate 17 can also be provided with an externally threaded hollow stub which communicates with the channel or slot and projects through a preformed opening in the end wall of the body portion 12 to engage a correspondingly internally threaded end of a port 19. The partition plate 16 can be secured and mounted on the spacer plates 17 by means of bolts passing through countersunk holes in the plate 16 and engaging in tapped holes in the spacer plates. The construction is such that the spacer plates can be removed and replaced without difficulty. A substantially conical member 20 (FIG 2) having a smooth convex surface can be mounted centrally on the side of partition plate 16 which faces the outlet 15 and on the axis of the outlet 15.

Figure 3:
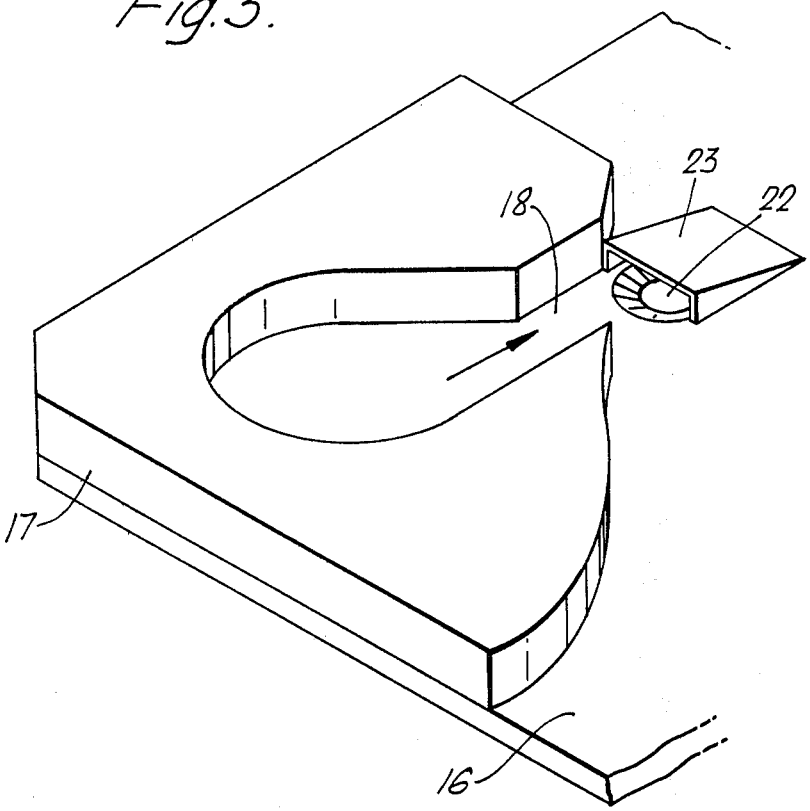
FIG. 3 is an enlarged view of the part of the amplifier in FIG. 1 which is within the dotted circular outline.

The volume between the partition plate 16 and the end wall of the body portion 12 defines a vortex chamber 21. The free edges of the partition plate 16 between the spacer plates can be chamfered or rounded. Apertures 22 are formed in the partition plate 16 at positions adjacent the nozzles 18. The apertures 22 are preferably inclined in the direction of control flow issuing through the nozzles and as indicated by the arrow in FIG. 3. The inclination encourages a part of the control flow to pass through the nozzles to mix with the inlet flow at the opposite side of the partition plate. To assist in the deflection of a part of the control flow through the apertures a cowl 23 can be mounted on the partition plate and over the apertures 22. The height of the cowl 23 will be considerably less than the height of the spacer plate and will be determined by the amount of control flow to be diverted to the inlet side of the partition plate. Clearly, means other than a cowl can be used to assist in the deflection of part of the control flow through the aperture 22. For example, a low barrier or wall can be mounted on the partition plate 16 at the rear (downstream) edge of the aperture 22.

In operation, a fluid supply at the inlet 14 enters the casing and passes over the free edges of the partition plate 16 into the vortex chamber. From the vortex chamber the fluid enters the diffuser outlet 15. A control flow at the ports 19 enters the vortex chamber tangentially through the nozzles 18 to throttle the flow through the chamber. A portion of the control flow is diverted through the apertures 22 to mix with the incoming supply flow at the opposite side of the partition plate 16.

Figure 4:
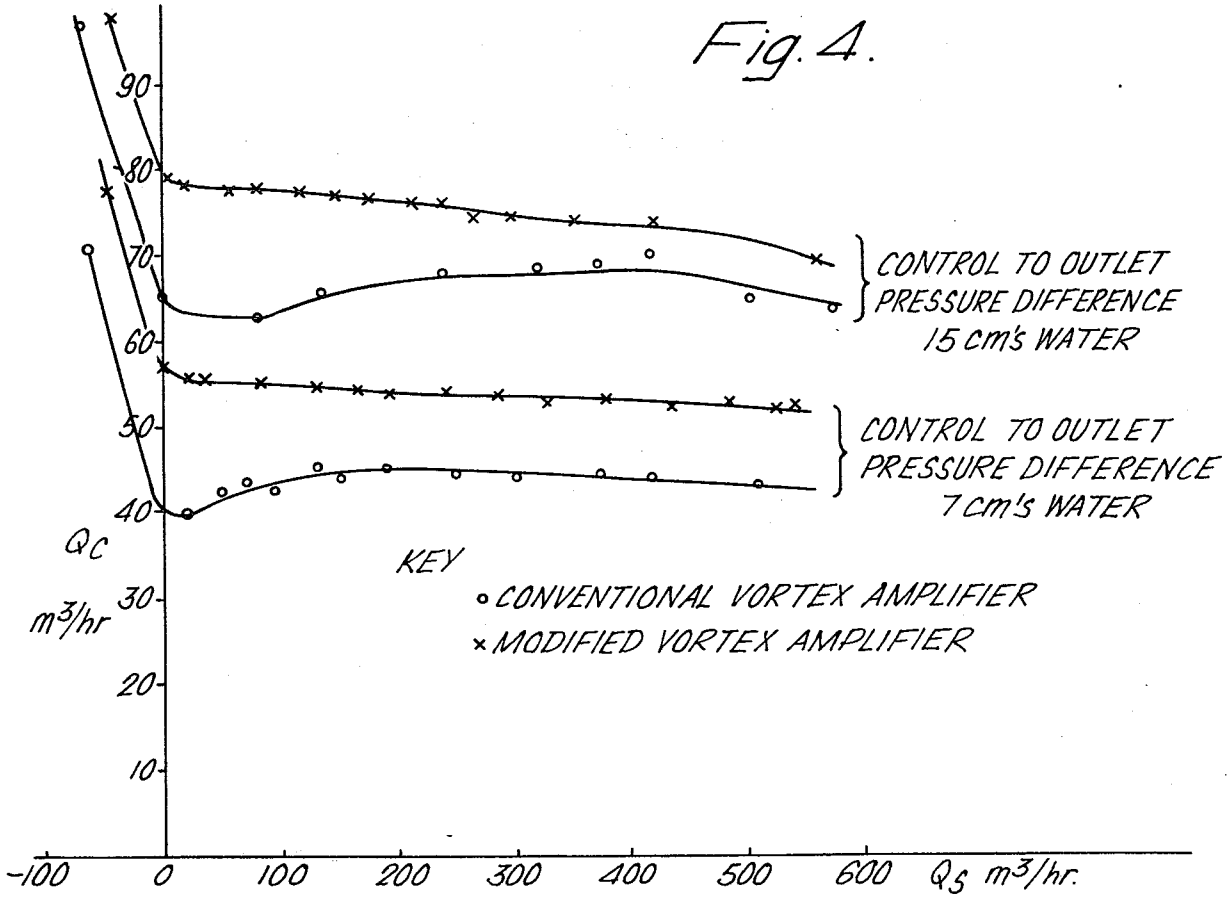
FIG. 4 shows characteristics of a known vortex amplifier and a vortex amplifier according to the invention.

FIG. 4 illustrates the effect and compares the characteristics of a conventional vortex amplifier with that of a geometrically identical vortex amplifier having apertures in the partition plate. The characteristics take the form of a plot of control flow Qc against inlet flow Qs at a constant control to outlet pressure difference. Two comparison plots are given in FIG. 4, namely at control to outlet pressure differences of 7 cms and 15 cms water gauge. As seen at least two values of Qs are possible for a given value of Qc in existing vortex amplifiers and in the usual operating range of Qs between −50 to +250 $m^3$/hr. The positive slope of the characteristics of existing vortex amplifiers at the lower positive values of Qs can result in "hunting" and instability with consequent surging in the vortex amplifier. As seen from the characteristics this effect is eliminated when the vortex amplifier is modified by forming apertures in the partition plate as proposed by the present invention.

I claim:

1. A fluidic control device, in particular a vortex amplifier, comprising a casing, a supply fluid inlet communicating with the interior of the casing through a central opening in one end wall of the casing, a fluid outlet shaped as a diffuser communicating with the interior of the casing through a central opening in the opposite end wall of the casing, a plate within the casing and cooperating with the opposite end wall to form a vortex chamber, at least one further inlet for a control fluid in a wall of the casing, a spacer member defining a part of the periphery of the vortex chamber and disposed between the plate and the opposite end wall of the casing, a channel in the member communicating with the further inlet for directing control fluid into the vortex chamber, and in which characterised in that an aperture is formed in the plate adjacent the channel in the member whereby to divert a portion of the control fluid to the side of the plate facing the supply fluid inlet.

2. A fluidic control device according to claim 1 including a plurality of control fluid inlets, each inlet communicating with a channel in a respective spacer member.

3. A fluidic control device according to claim 1 in which the aperture is inclined in the direction of control flow issuing from the channel.

4. A fluidic control device according to claim 3 including deflector means mounted on the plate to assist in the deflection of control flow through the aperture.

5. A fluidic control device according to claim 4 in which the deflection means comprises a cowl mounted on the plate over the aperture and having a height less than the height of the spacer member.

* * * * *